US009281580B2

(12) United States Patent
Yincheng et al.

(10) Patent No.: US 9,281,580 B2
(45) Date of Patent: Mar. 8, 2016

(54) CONNECTOR

(71) Applicant: NingDe Contemporary Amperex Technology Limited, NingDe, FuJian Province (CN)

(72) Inventors: Huang Yincheng, NingDe (CN); Xiang Yanhuo, NingDee (JP)

(73) Assignee: Ningde Contemporary Amperex Technology Limited, Ningde, Fujian (CN)

( * ) Notice: Subject to any disclaimer, the term of this patent is extended or adjusted under 35 U.S.C. 154(b) by 0 days.

(21) Appl. No.: 14/598,183

(22) Filed: Jan. 15, 2015

(65) Prior Publication Data

US 2015/0255898 A1 Sep. 10, 2015

(30) Foreign Application Priority Data

Mar. 6, 2014 (CN) ..... 2014 1 0079461

(51) Int. Cl.

| | |
|---|---|
| ***H01R 11/01*** | (2006.01) |
| *H01R 4/30* | (2006.01) |
| *H01R 4/34* | (2006.01) |
| *H01R 11/12* | (2006.01) |
| *H01R 13/512* | (2006.01) |

(52) U.S. Cl.

CPC ..... *H01R 11/01* (2013.01); *H01R 4/301* (2013.01); *H01R 4/34* (2013.01); *H01R 11/12* (2013.01); *H01R 13/512* (2013.01)

(58) Field of Classification Search

CPC ..... H01R 4/301; H01R 11/01; H01R 11/12; H01R 2101/00

See application file for complete search history.

(56) References Cited

U.S. PATENT DOCUMENTS

2015/0255898 A1 * 9/2015 Yincheng ..... H01R 11/01 439/628

* cited by examiner

*Primary Examiner* — Ross Gushi
(74) *Attorney, Agent, or Firm* — Arent Fox LLP

(57) ABSTRACT

One aspect of the present disclosure is directed to a connector. The connector includes a top cover, a connecting plate, and a base. The top cover includes a top cover body and a first arc member. A first end of the first arc member is arranged on a side surface of the top cover body. A removable thin plate is arranged inside the first arc member. The connecting plate includes a connection section and a protruding section. The top cover body and the base are engaged and connected to form a cavity. The connection section is arranged inside the cavity. The connection section is connected to the base. A first end of the protruding section is connected to the connection section and a second end of the protruding section protrudes from the base.

10 Claims, 11 Drawing Sheets

CONNECTOR

CROSS-REFERENCE TO RELATED APPLICATION(S)

This application claims the benefit of Chinese Patent Application No. CN201410079461.2, entitled "CONNECTOR" and filed on Mar. 6, 2014 in the State Intellectual Property Office of the People's Republic of China (PRC) (SIPO), the disclosure of which is expressly incorporated by reference herein in its entirety.

BACKGROUND

1. Field

The present disclosure relates generally to the field of connectors, and more particularly, to connectors with a simple structure, low manufacturing cost, capable of providing a variety of ways of connections, and capable of providing output in multiple directions.

2. Background

Connectors are components that provide connection and isolation functions among electrical or battery terminals. As connectors can be applied in extensive fields, such as transportation, communication, network, information technology (IT), medical care, and household electrical appliances, connectors have numerous different types. Moreover, one type of connector may be vastly different from another type of connector in structure.

Connectors are also basic components of complete lithium battery packs, battery cabinets, and battery systems for electric automobiles. Because different battery packs may have different ways and directions of connections, connectors are required to be able to provide a variety of ways of connections and, at the same time, to provide output in multiple directions, so as to be adapted to various circumstances and expand the application range of the connectors.

Conventional connectors, however, do not meet the above-mentioned requirements. They can only provide one way of connection, for example, only provide a cable connection, or only provide a busbar connection. It can be difficult to perfectly integrate several different ways of connection. Moreover, conventional connectors can only achieve output in one direction. As a result, the application range of the conventional connectors has been greatly restricted. Meanwhile, conventional connectors further have drawbacks of complex structure and high manufacturing cost.

In light of this, it is indeed necessary to provide a connector with simple structure, low manufacturing cost, capable of providing a variety of ways of connections, and capable of providing output in multiple directions.

SUMMARY

The object of the present disclosure is to overcome the drawbacks of the prior art by providing a connector with simple structure, low manufacturing cost, capable of providing a variety of ways of connections, and capable of providing output in multiple directions.

To attain the above-mentioned objectives, the present disclosure describes a connector that includes a top cover, a connecting plate, and a base. The top cover includes a top cover body and a first arc member. A first end of the first arc member is arranged on a side surface of the top cover body. A removable thin plate is arranged inside the first arc member. The connecting plate includes a connection section and a protruding section. The top cover body and the base are engaged and connected to form a cavity. The connection section is arranged inside the cavity. The connection section is connected to the base. A first end of the protruding section is connected to the connection section and a second end of the protruding section protrudes from the base.

In one aspect, the removable thin plate is embedded in or welded to a second end of the first arc member.

In one aspect, the removable thin plate is formed with a hole thereon.

In one aspect, the hole is formed at an edge of the removable thin plate.

In one aspect, the connector further includes a protection cover. An end of the protection cover is arranged on a side surface of the base. The protection cover includes a second arc member. The first arc member and the second arc member are engaged to form an accommodation space.

In one aspect, the connection section is formed with a first through hole. The second end of the protruding section is formed with a second through hole.

In one aspect, at least one side of the top cover body has an extension portion. The extension portion is formed with a third through hole.

In one aspect, the base is provided with a recess, installation holes, a first buckle for fixing the connection section, a base through hole that allows the protruding section to extend through, and a second buckle for engaging with the third through hole to fix the top cover body and to connect the base and the protection cover. The connector further includes a switch bolt and a locking nut assembly. A head of the switch bolt is accommodated in the recess. A threaded rod of the switch bolt extends through the first through hole and is fixed inside the locking nut assembly.

In one aspect, the locking nut assembly includes a locking nut and an elastic gasket. The elastic gasket is arranged between the locking nut and the threaded rod.

In one aspect, the connection section and the protruding section are arranged to be perpendicular to each other.

Certain configurations of the present disclosure may form a first arc member on the top cover body, and arrange a removable thin plate inside the first arc member. As a result, configurations of the present disclosure not only can output via a connecting plate, but also can output via a cable connection or the like when the removable thin plate is removed, which greatly expands the application range of the present disclosure. Moreover, certain configurations of the present disclosure may have a simple structure, low manufacturing cost, convenient assembly, and high reliability. Certain configurations can be extensively applied on high-voltage connection in lithium battery packs, battery cabinets, and battery systems for electric automobiles.

By providing a protection cover, in addition, certain configurations of the present disclosure can support busbars or cables functioning as output terminals. Moreover, the assembly of the protection cover to the base is flexible such that the protection cover can be assembled to different side surfaces of the base to provide output in multiple directions, which further expands the application range of certain configurations of the present disclosure.

DETAILED DESCRIPTION

The present disclosure and the advantageous effects of certain configurations will be further described in detail below with reference to the accompanying drawings and specific embodiments.

Figure 1:
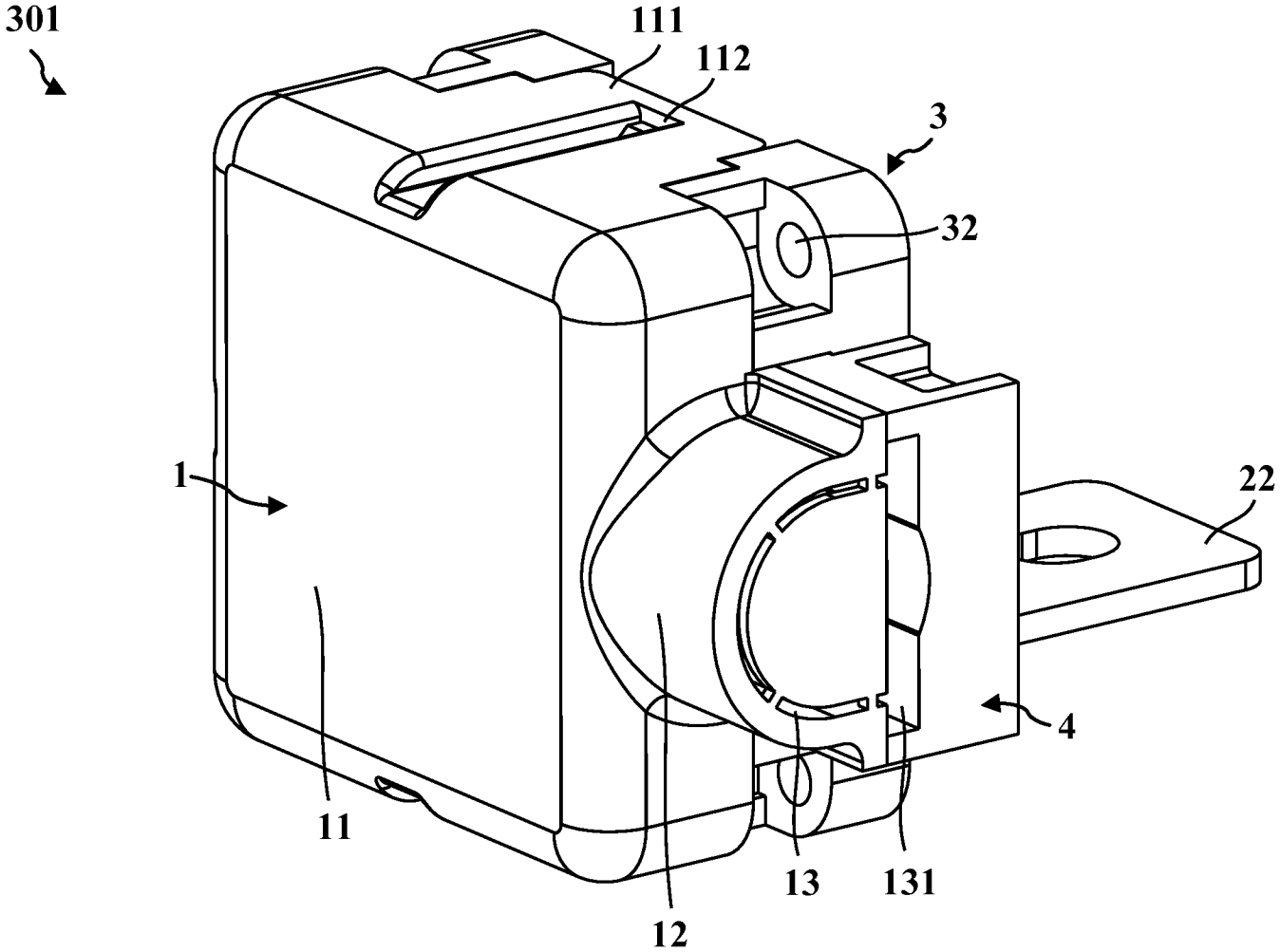
FIG. 1 is a diagram illustrating the structure of an exemplary connector of the present disclosure.
Figure 2:
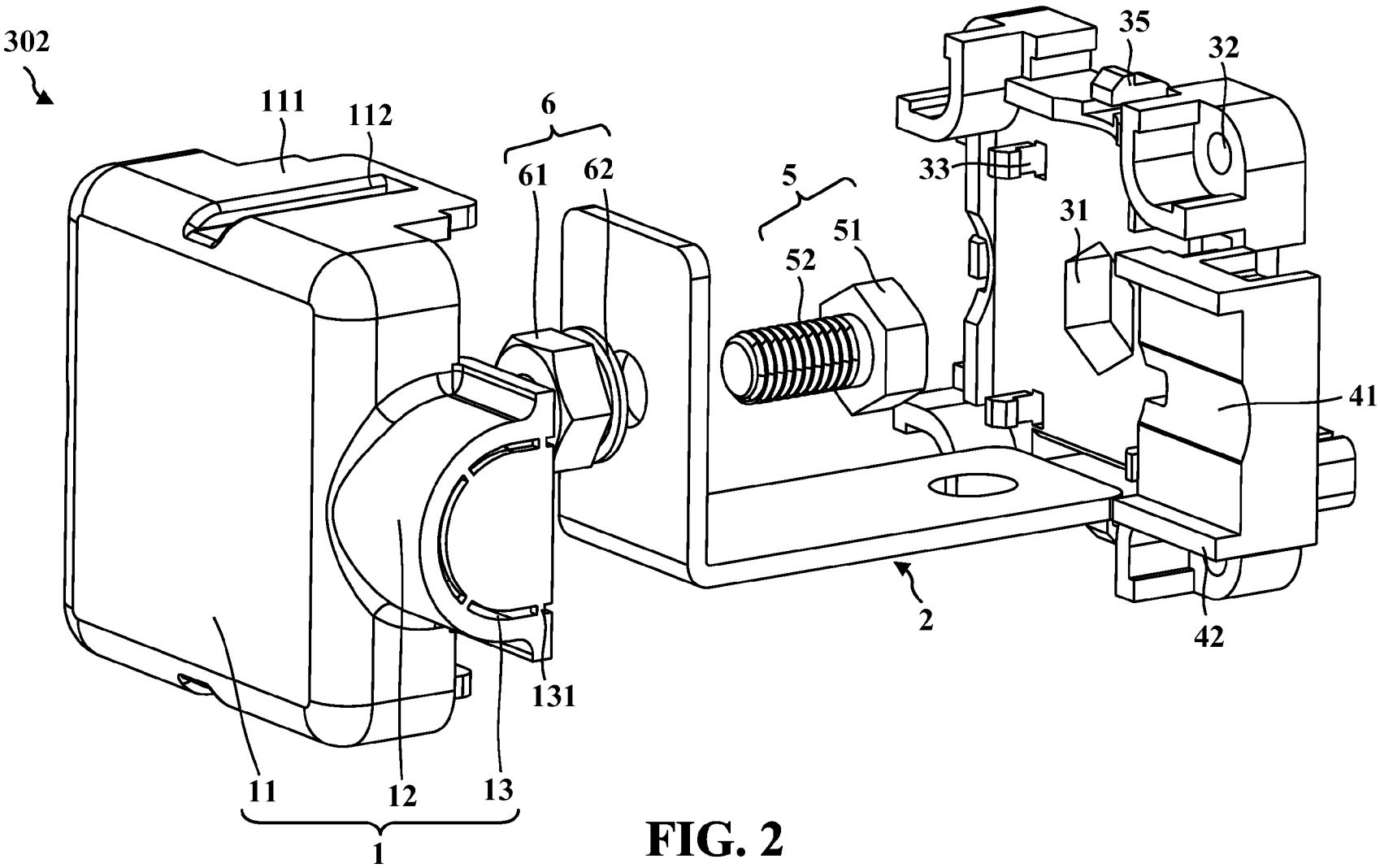
FIG. 2 is a diagram illustrating an exploded view of an exemplary connector of the present disclosure.
Figure 3:
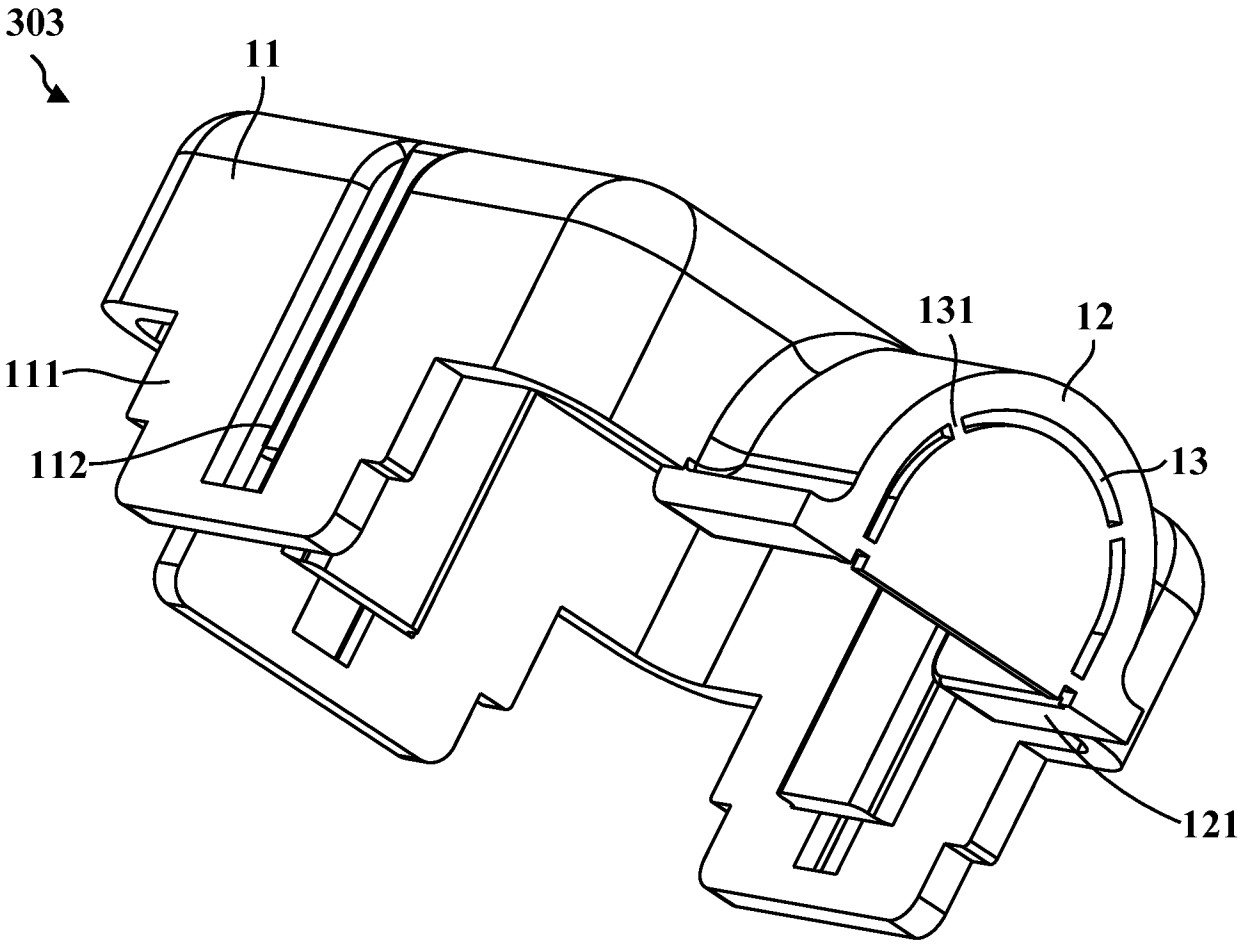
FIG. 3 is a diagram illustrating the structure of a top cover of an exemplary connector according to the present disclosure.
Figure 4:
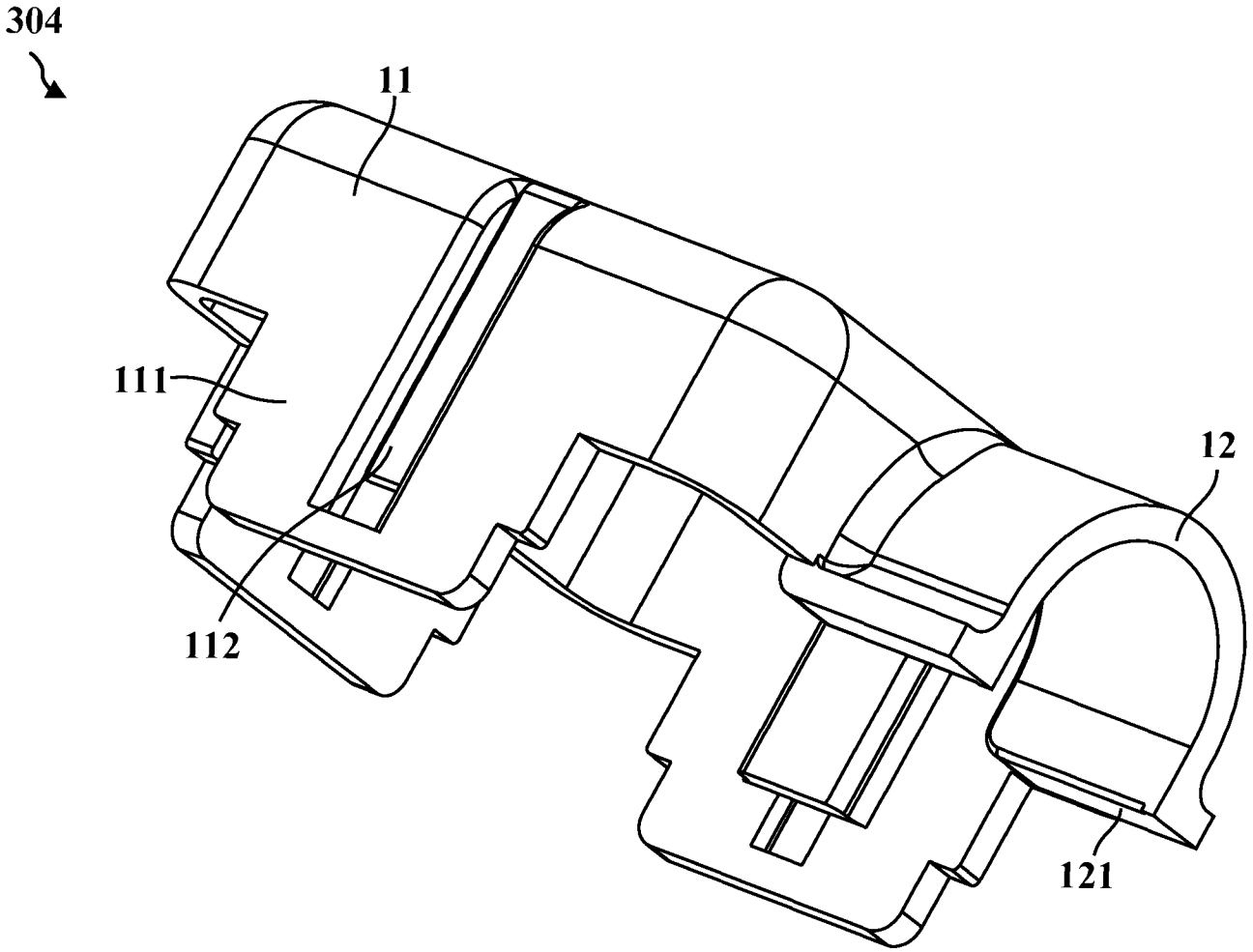
FIG. 4 is a diagram illustrating a three-dimensional view of the top cover of an exemplary connector with a removable thin plate removed according to the present disclosure.
Figure 5:
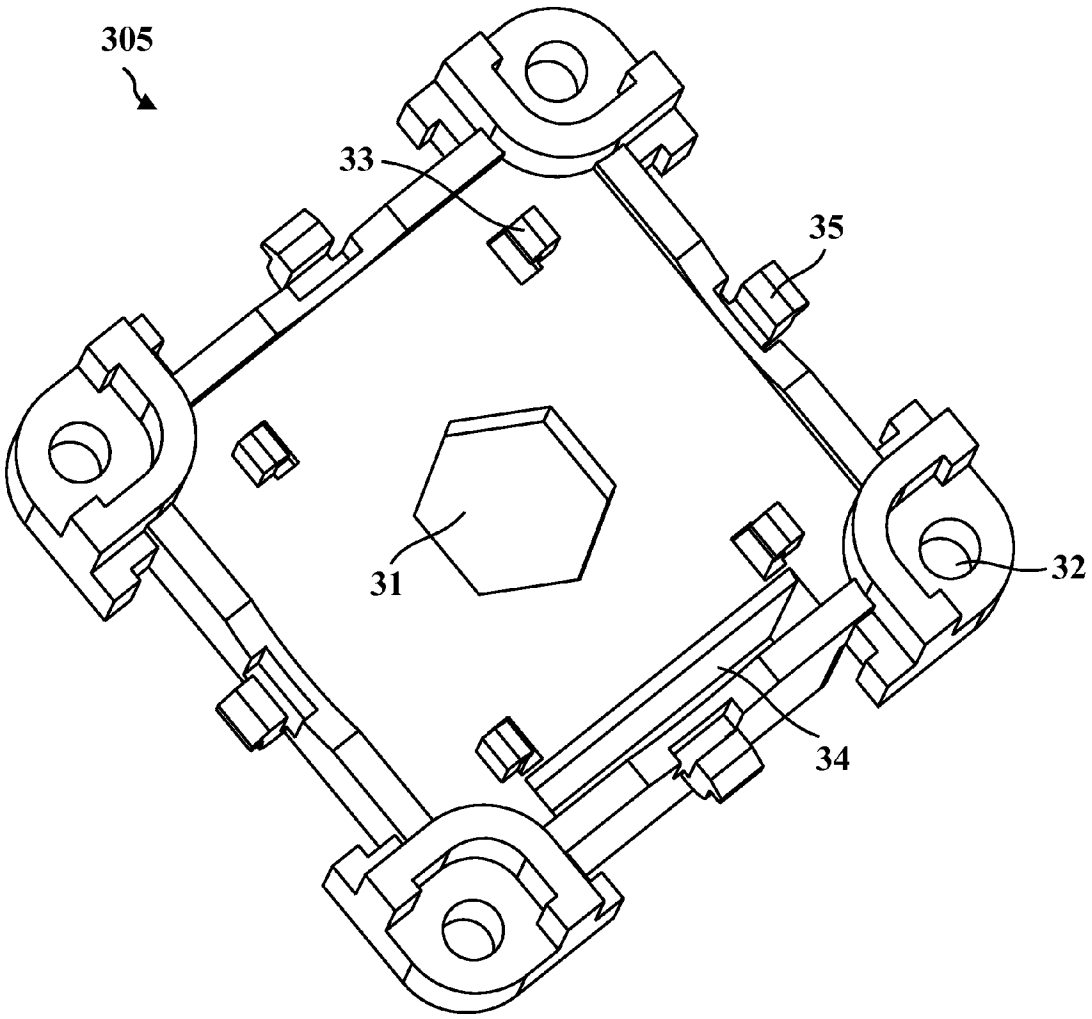
FIG. 5 is a diagram illustrating a top view of a base of an exemplary connector according to the present disclosure.
Figure 6:
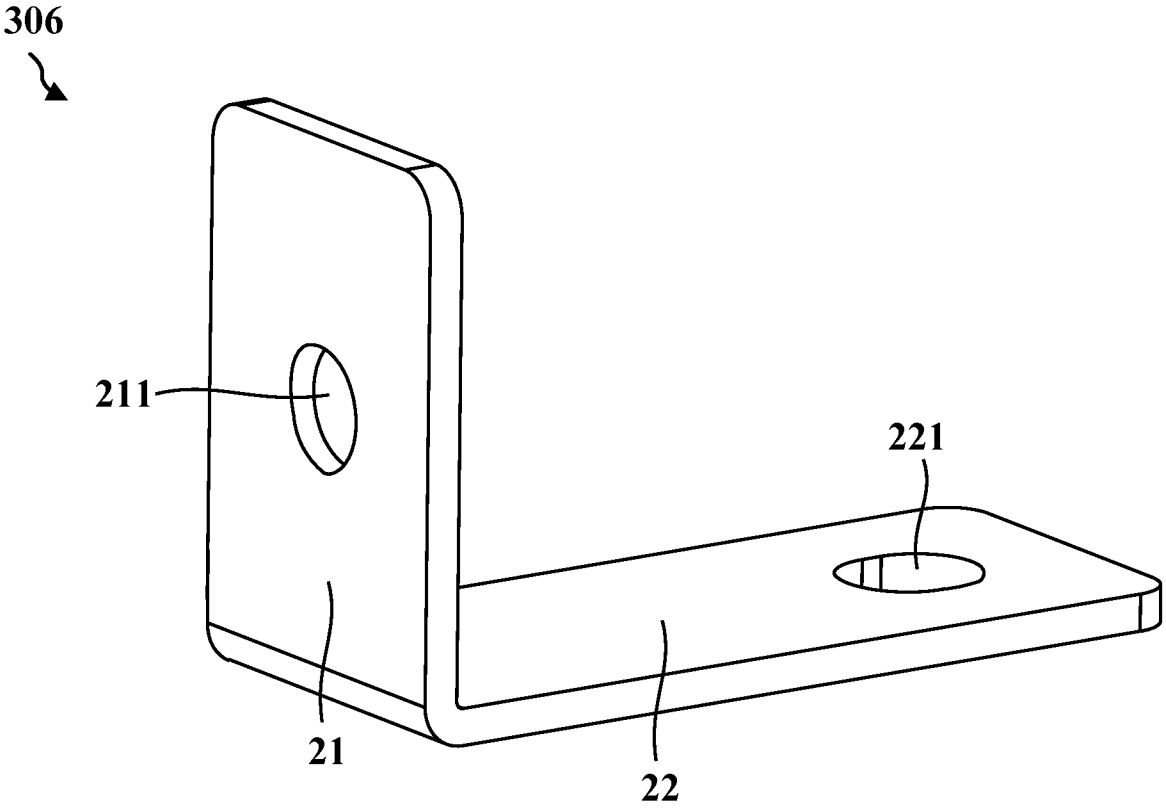
FIG. 6 is a diagram illustrating the structure of a connecting plate of an exemplary connector.

FIG. 1 is a diagram 301 illustrating the structure of an exemplary connector of the present disclosure. FIG. 2 is a diagram 302 illustrating an exploded view of an exemplary connector of the present disclosure. FIG. 3 is a diagram 303 illustrating the structure of a top cover of an exemplary connector according to the present disclosure. FIG. 4 is a diagram 304 illustrating a three-dimensional view of the top cover of an exemplary connector with a removable thin plate removed according to the present disclosure. FIG. 5 is a diagram 305 illustrating a top view of a base of an exemplary connector according to the present disclosure. FIG. 6 is a diagram 306 illustrating the structure of a connecting plate of an exemplary connector. As shown in FIG. 1 to FIG. 6, a connector according to the present disclosure includes a top cover 1, a connecting plate 2, and a base 3. The top cover 1 includes a top cover body 11 and a first arc member 12. One end of the first arc member 12 is arranged on one side surface of the top cover body 11, and a removable thin plate 13 is arranged inside the first arc member 12. In one embodiment, the top cover body 11 includes a bottom face and four side faces perpendicular to the bottom face. The first arc member 12 is arranged on the external surface of one of the side faces, and the projection of the first arc member 12 on this side surface is C-shaped with a radian greater than π.

An output terminal may interface with the connector at hole 131. When an output terminal is a flat component like a busbar (e.g., the busbar 7 in FIGS. 7 and 8), the removable thin plate 13 can restrict the component, thus preventing the component from shaking or being deformed. As an output terminal, a busbar is suitable for connection over a short distance.

When an output terminal is a component of a cylindrical structure such as a cable (e.g., the cable 8 in FIG. 9), the removable thin plate 13 can be removed such that the entire first arc member 12 is open between two ends thereof, restricting the cable inside the first arc member 12.

The top cover body 11 and the base 3 are engaged and connected to form a cavity. As an output terminal, a cable is relatively suitable for connection over a long distance.

The connecting plate 2 includes a connection section 21 and a protruding section 22. The connection section 21 and the protruding section 22 are arranged perpendicular to each other. That is, the connecting plate 2 is L-shaped. The connecting plate 2 can be made of copper, aluminum, gold, or silver. These materials have good electrical conductivity. Copper or aluminum may be preferred, as gold and silver are expensive, which is unfavorable for lowering the cost.

The connection section 21 is arranged inside the cavity, and the connection section 21 is connected to the base 3. One end of the protruding section 22 is connected to the connection section 21, and the other end thereof protrudes from the base 3. The connection section 21 is used for connecting with a busbar or a cable that is used as an output terminal, and the protruding section 22 is used for connecting with positive and negative electrodes of a battery that are used as output terminals.

The removable thin plate 13 is embedded or welded to the other end of the first arc member 12, i.e., the removable thin plate 13 is arranged at the end of the first arc member 12 that is far from the top cover body 11. The cross-sectional shape of the removable thin plate 13 is of a bow shape, and the edge of the removable thin plate 13 has a C shape with a radian greater than π. In one configuration, the thickness of the removable thin plate 13 is 0.01~1 mm.

The removable thin plate 13 is formed with a hole 131 thereon, and the hole 131 is formed at the edge of the removable thin plate 13. In such a way, when the removable thin plate 13 is pressed, it is easy to separate the removable thin plate 13 from the first arc member 12.

The connector further includes a protection cover 4. One end of the protection cover 4 is arranged on one side surface of the base 3. The protection cover 4 is provided with a second arc member 41. The first arc member 12 and the second arc member 41 are engaged to form an accommodation space. The accommodation space allows a cable and others to extend through the accommodation space. The role of the protection cover 4 is to support a busbar or a cable functioning as an output terminal (see FIGS. 7 to 10), and to restrict and to protect the output terminal so as to prevent damage during use. The second arc member 41 is arranged in the middle of the protection cover 4 with an arc shape and a radian less than π. In one embodiment, the protection cover 4 and the first arc member 12 are connected such that flanges 42 are formed on two ends of the protection cover 4, and locking slots 121 are provided on two ends of the first arc member 12 for engaging with the flanges 42.

The connection section 21 is formed with a first through hole 211, and the other end of the protruding section 22 is formed with a second through hole 221. The first through hole 211 is used for fixing the connection section 21 in the cavity, and the second through hole 221 is used for connecting with positive and negative electrodes of a battery.

At least one side of the top cover body 11 is provided with an extension portion 111. The extension portion 111 is formed with a third through hole 112, and the third through hole 112 is a bar-shaped hole.

Figure 11:
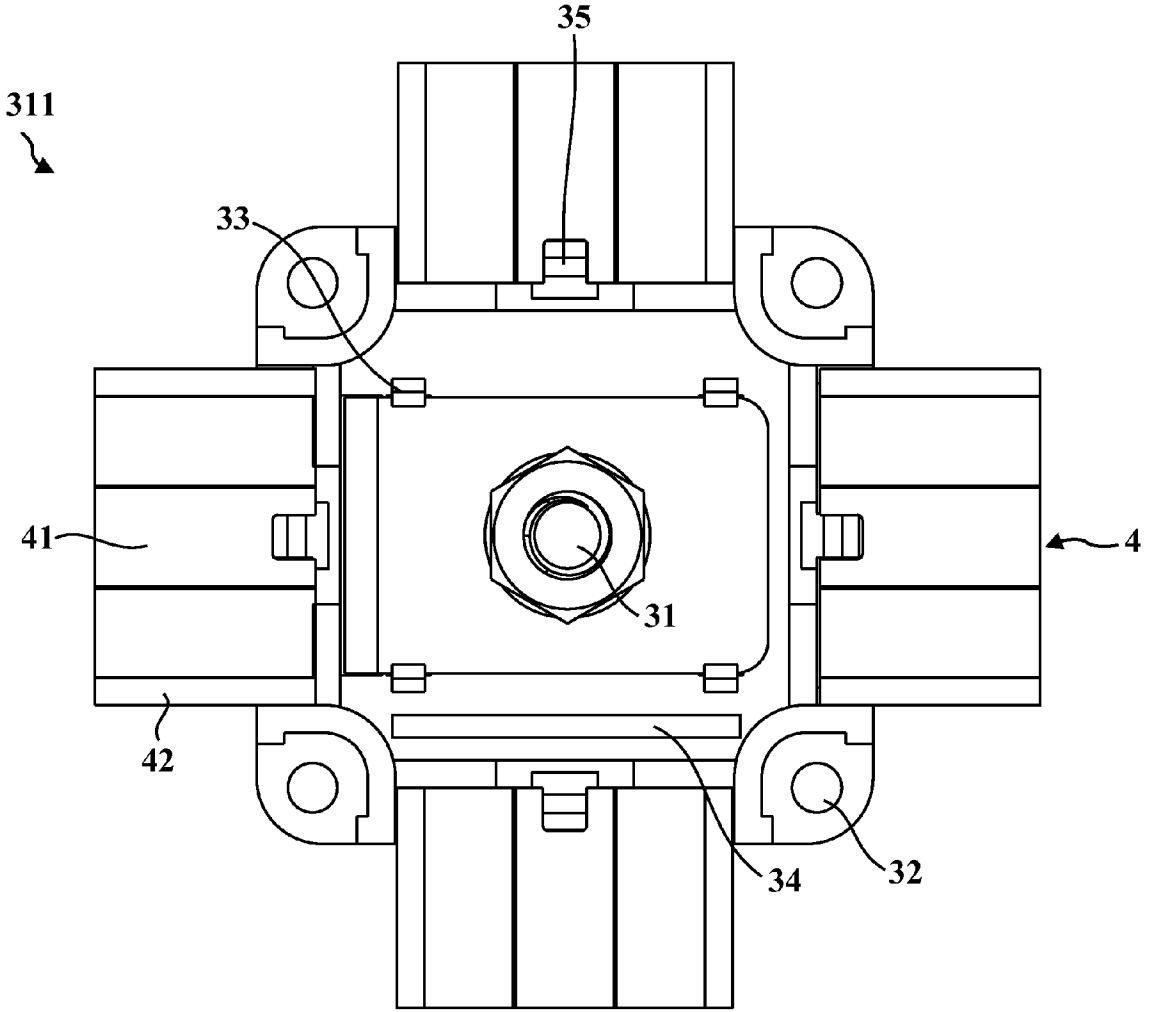
FIG. 11 illustrates the structure of an exemplary connector of the present disclosure with a protection cover provided in four directions of the base.

The base 3 has a recess 31, installation holes 32, a first buckle 33 for fixing the connection section 21, a base through hole 34 for the protruding section 22 to extend through, and a second buckle 35 for engaging with the third through hole 112 to fix the top cover body 11 and for connecting the base 3 and the protection cover 4. That is, the top cover body 11 and the base 3 are connected via a buckle, and the protection cover 4 and the base 3 are connected also via a buckle. The base 3 is of a square structure. Four second buckles 35 are provided. The four second buckles 35 are arranged at the four edges of the base 3, respectively. Therefore, the protection cover 4 may be connected to the base 3 via any one of the four second buckles 35 (as shown in FIG. 11). As a result, the connector can allow output in four different directions, which can consequently expand the application range of the connector.

The installation holes 32 are used for installing the entire connector onto an article that needs the connector, such as a battery pack, a battery cabinet, etc. Four first buckles 33 are provided, which can fix the connection section 21 and prevent the connection section 21 from shaking The connector further includes a switch bolt 5 and a locking nut assembly 6. The head 51 of the switch bolt 5 is accommodated in the recess 31. The threaded rod 52 of the switch bolt 5 extends through the first through hole 211 and is fixed inside the locking nut assembly 6, thus fixing the connecting plate 2.

The locking nut assembly 6 includes a locking nut 61 and an elastic gasket 62, and the elastic gasket 62 is arranged between the locking nut 61 and the threaded rod 52. The elastic gasket 62 may enhance the connection between the locking nut 61 and the switch bolt 5.

APPLICATION EXAMPLE 1

Figure 7:
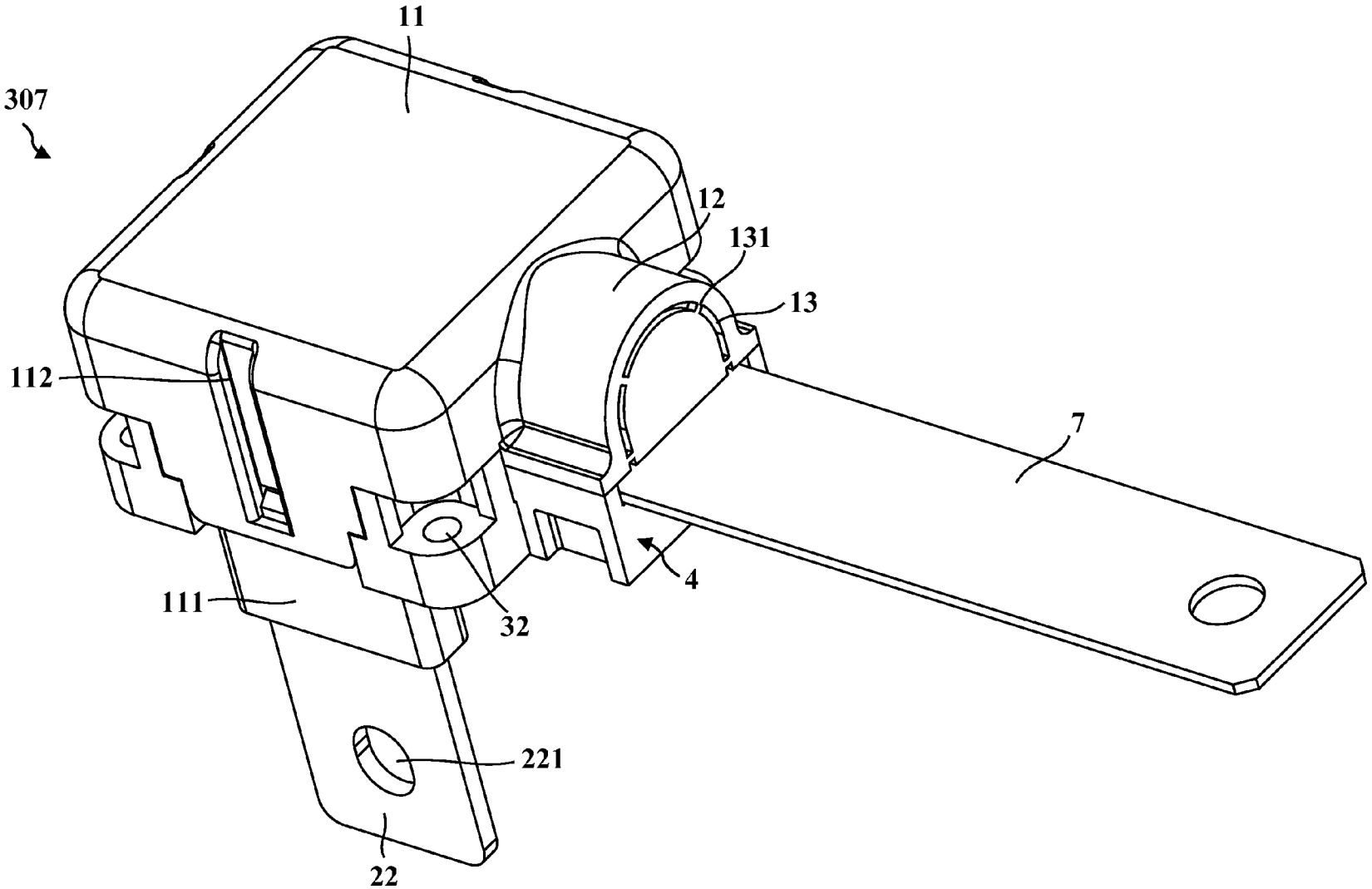
FIG. 7 is a three-dimensional view of an exemplary connector of the present disclosure connected to a busbar.
Figure 8:
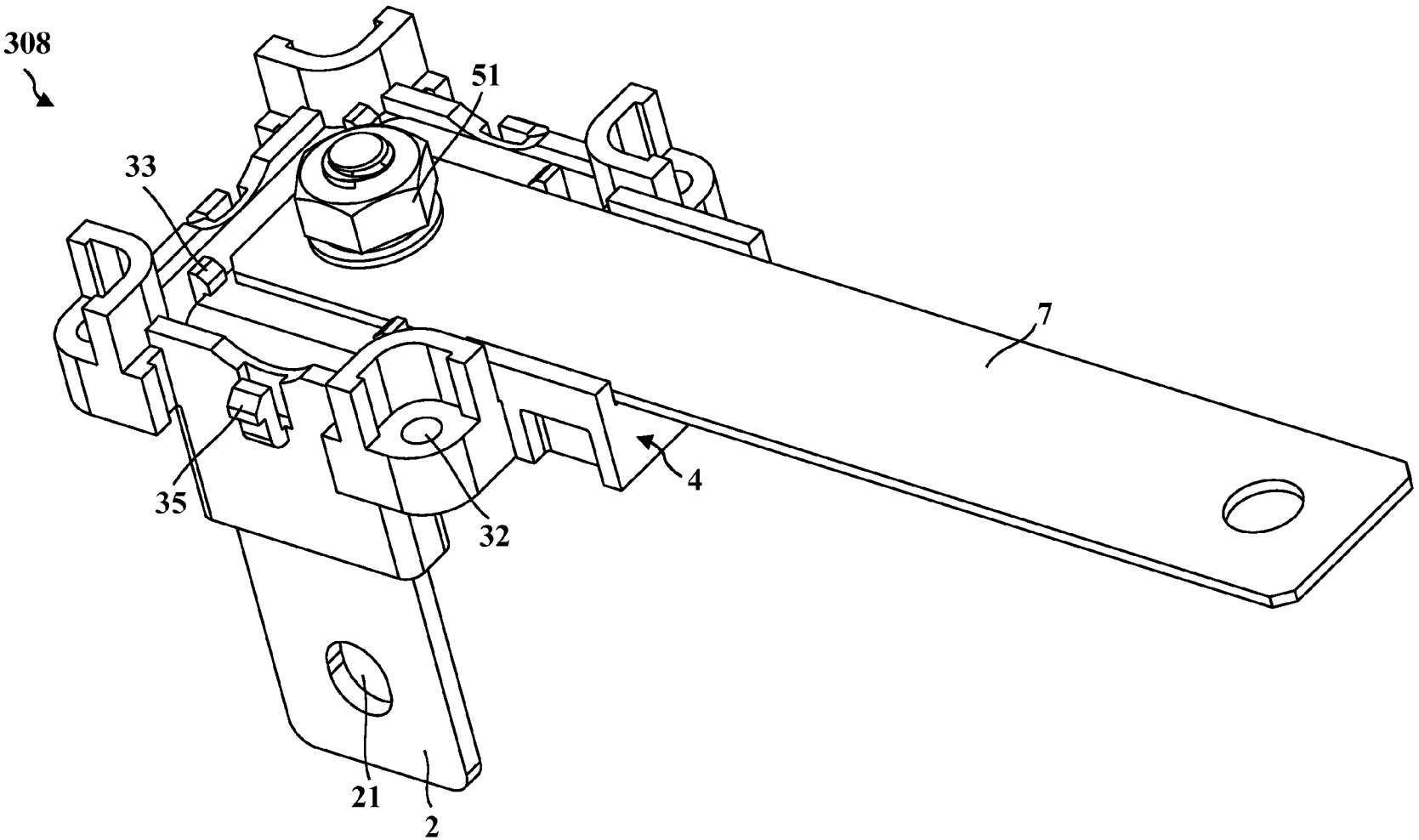
FIG. 8 is a three-dimensional view of the exemplary connector of FIG. 7 with the top cover removed.

As shown in FIGS. 7 and 8, when the busbar 7 is used as an output terminal, two ends of the busbar 7 are formed with holes. Initially, extend the protruding section 22 through the base through hole 34. At the same time, place the head 51 of the switch bolt 5 in the recess 31. Then, extend the end of the threaded rod 52 through the first through hole 211 and the hole at one end of the busbar 7 sequentially to reach the elastic gasket 62 in the locking nut 61. Tight the locking nut 61. Use a first buckle 33 to fix the connection section 21. Subsequently, use a second buckle 35 to fix the protection cover 4 to a side face of the base 3, and extend the busbar 7 from the upper edge of the protection cover 4. Then, install the top cover 1 such that the first arc member 12 is arranged opposite to the protection cover 4. Thus, the busbar 7 is fixed between the first arc member 12 and the protection cover 4. Then, insert the other three first buckles 33 into the third through hole 112, respectively, thereby fixing the top cover 1 and the base 3.

When this connector needs to be used on battery packs, battery cabinets, or battery systems for electric automobiles, extend bolts through the installation holes 32 to reach into the threaded holes on the installation surface the equipment. Then, the connector can be installed on the equipment.

APPLICATION EXAMPLE 2

Figure 9:
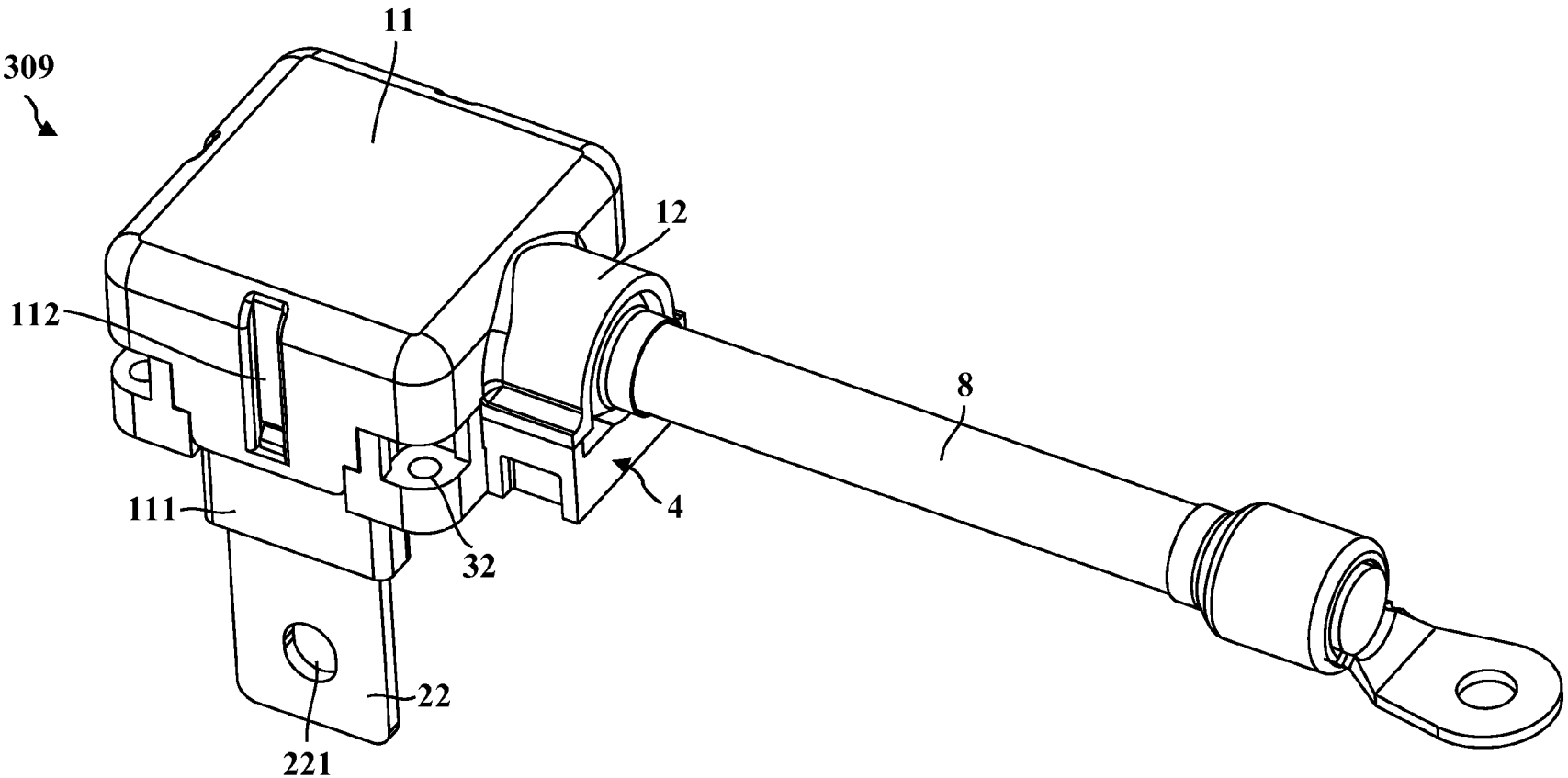
FIG. 9 is a three-dimensional view of an exemplary connector of the present disclosure connected to a high-voltage cable.
Figure 10:
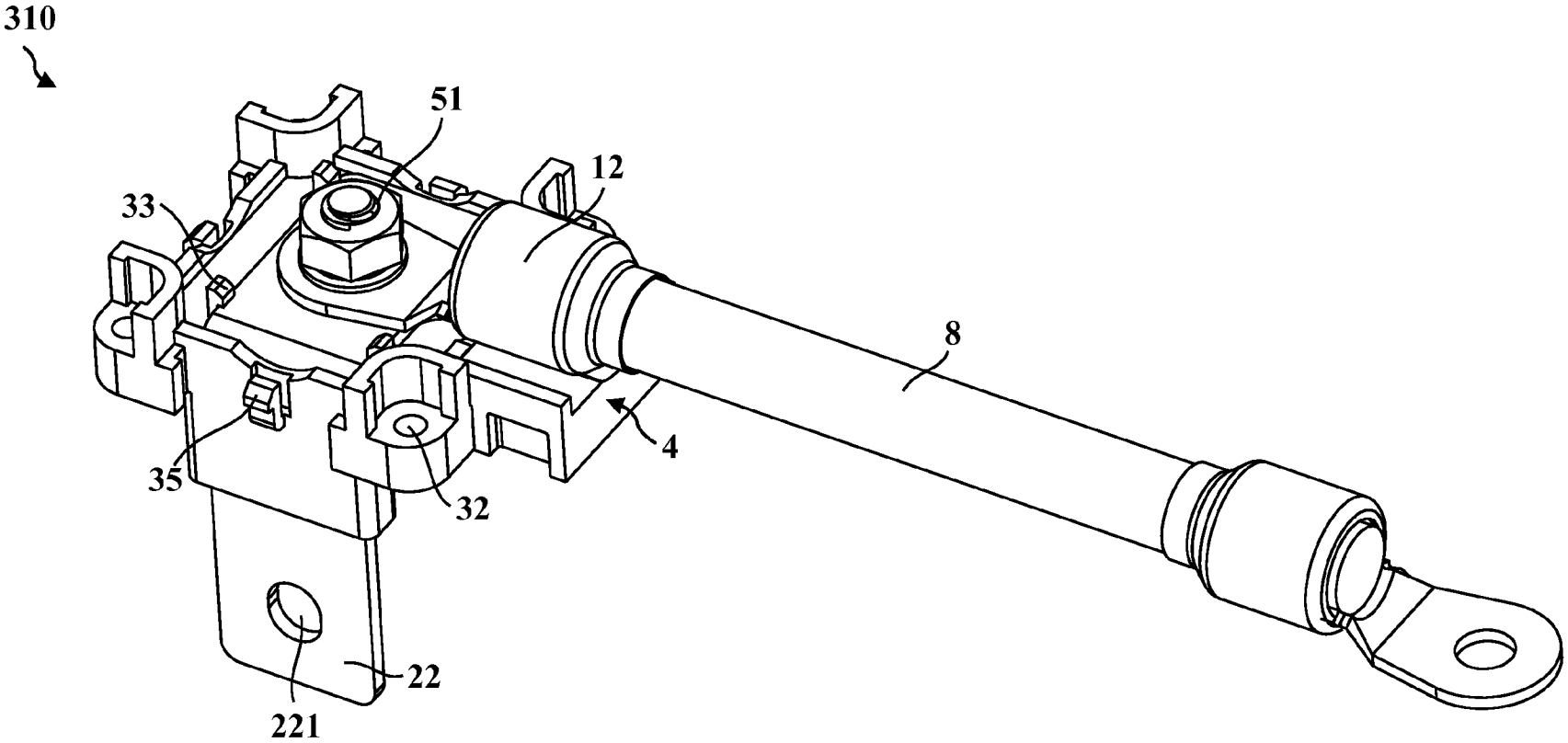
FIG. 10 is a three-dimensional view of FIG. 9 with the top cover removed.

As shown in FIGS. 9 and 10, when a cable 8 is used as the output terminal, two ends of the cable 8 are formed with connection holes. Initially, extend the protruding section 22 through the base through hole 34. At the same time, place the head 51 of the switch bolt 5 in the recess 31. Then, extend the end of the threaded rod 52 through the first through hole 211 and the hole at one end of the cable 8 sequentially to reach the elastic gasket 62 in the locking nut 61. Tight the locking nut 61. Use a first buckle 33 to fix the connection section 21. Subsequently, use a second buckle 35 to fix the protection cover to a side face of the base 3. Place the bottom of the cable 8 is in contact with the second arc member 41 of the protection cover 4 or above the second arc member 41.

Then, press the removable thin plate 13 with a hand or tool such that the entire first arc member 12 is open between two ends thereof Subsequently, install the top cover 1 such that the first arc member 12 is arranged opposite to the protection cover 4. This, the cable 8 is fixed inside the accommodation space formed by the first arc member 12 and the protection cover 4. Then, insert the other three first buckles 33 into each third through hole 112, respectively, thereby fixing the top cover 1 and the base 3.

When this connector needs to be used on battery packs, battery cabinets, and battery systems for electric automobiles, extend bolts through the installation holes 32 to reach into the threaded holes on the installation surface the equipment. Then, the connector can be installed on the equipment.

According to the disclosure and description above, those skilled in the art may further make variations and modifications to the above embodiments. Therefore, the present disclosure is not limited by the specific embodiments disclosed and described above. Some equivalent variations and modifications to the present disclosure shall also be encompassed the claims of the present disclosure. Although the Description uses some specific terms, in addition, the terms are used only for the purpose of easy description, which do not constitute any limitation to the present disclosure.

What is claimed is:

1. A connector, comprising a top cover including a top cover body, and a first arc member, wherein a first end of the first arc member is arranged on a side surface of the top cover body, and wherein a removable thin plate is arranged inside the first arc member;

a connecting plate including:

a connection section, and a protruding section; and a base, wherein the top cover body and the base are engaged and connected to form a cavity, wherein the connection section is arranged inside the cavity, and wherein the connection section is connected to the base, wherein a first end of the protruding section is connected to the connection section and a second end of the protruding section protrudes from the base.

2. The connector of claim 1, wherein the removable thin plate is embedded in or welded to a second end of the first arc member.

3. The connector of claim 1, wherein the removable thin plate is formed with a hole thereon.

4. The connector of claim 3, wherein the hole is formed at an edge of the removable thin plate.

5. The connector of claim 1, wherein the connector further comprises a protection cover, wherein an end of the protection cover is arranged on a side surface of the base, wherein the protection cover includes a second arc member, and wherein the first arc member and the second arc member are engaged to form an accommodation space.

6. The connector of claim 5, wherein the connection section is formed with a first through hole, and wherein the second end of the protruding section is formed with a second through hole.

7. The connector of claim 6, wherein at least one side of the top cover body has an extension portion, and wherein the extension portion is formed with a third through hole.

8. The connector of claim 7, wherein the base is provided with a recess, installation holes, a first buckle for fixing the connection section, a base through hole that allows the protruding section to extend through, and a second buckle for engaging with the third through hole to fix the top cover body and to connect the base and the protection cover;

wherein the connector further comprises a switch bolt and a locking nut assembly;

wherein a head of the switch bolt is accommodated in the recess; and wherein a threaded rod of the switch bolt extends through the first through hole and is fixed inside the locking nut assembly.

9. The connector of claim 8, wherein the locking nut assembly comprises a locking nut and an elastic gasket, and wherein the elastic gasket is arranged between the locking nut and the threaded rod.

10. The connector of claim 1, wherein the connection section and the protruding section are arranged to be perpendicular to each other.

* * * * *

UNITED STATES PATENT AND TRADEMARK OFFICE

CERTIFICATE OF CORRECTION

PATENT NO. : 9,281,580 B2
APPLICATION NO. : 14/598183
DATED : March 8, 2016
INVENTOR(S) : Huang Yincheng and Xiang Yanhuo It is certified that error appears in the above-identified patent and that said Letters Patent is hereby corrected as shown below:

Title Page

Inventors: (Item 72) reads:

72. Huang Yincheng, NingDe (CN); Xiang Yanhuo, NingDee (JP).

Inventors: (Item 72) should read:

72. Huang Yincheng, NingDe (CN); Xiang Yanhuo, NingDe (CN)..

Signed and Sealed this
Twenty-third Day of August, 2016

Michelle K. Lee

Michelle K. Lee
*Director of the United States Patent and Trademark Office*